US009368891B2

(12) United States Patent
Ozeki

(10) Patent No.: US 9,368,891 B2
(45) Date of Patent: Jun. 14, 2016

(54) ELECTRICAL CONNECTOR

(71) Applicant: Daiichi-Seko Co., Ltd., Kyoto-shi, Kyoto (JP)

(72) Inventor: Kosuke Ozeki, Ogori (JP)

(73) Assignee: DAIICHI-SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 14/925,886

(22) Filed: Oct. 28, 2015

(65) Prior Publication Data

US 2016/0134042 A1 May 12, 2016

(30) Foreign Application Priority Data

Nov. 12, 2014 (JP) ..... 2014-229634

(51) Int. Cl.
*H01R 13/627* (2006.01)
*H01R 12/77* (2011.01)

(52) U.S. Cl.
CPC ..... *H01R 12/771* (2013.01)

(58) Field of Classification Search
CPC ..... H01R 13/6215
USPC ..... 439/362, 364
See application file for complete search history.

(56) References Cited

U.S. PATENT DOCUMENTS 6,471,543 B1 * 10/2002 Balcombe ..... H01R 13/745 439/362
7,056,143 B2 * 6/2006 Arbogast ..... G06F 1/183 257/E23.086
7,056,144 B2 * 6/2006 Barsun ..... G06F 1/20 349/362

FOREIGN PATENT DOCUMENTS

JP 2011-065861 3/2011
JP 2013-125624 6/2013
JP 2013-125967 A 7/2015

* cited by examiner

*Primary Examiner* — Phuong Dinh
(74) *Attorney, Agent, or Firm* — Howard & Howard Attorneys PLLC

(57) ABSTRACT

Either one of a plug connector or a receptacle connector includes a receiver which is provided at a location corresponding to a fitting member inserted in a through hole when the connector parts are engaged with each other, and which receives, in an inner space via an opening, a catching member to be fitted with the inserted fitting member. In addition, the one connector includes a holder which holds the catching member received in the receiver by blocking off the opening of the receiver, and which includes a receiving hole permitting the inserted fitting member in the through hole to reach the inner space, and to be fitted with the catching member.

9 Claims, 18 Drawing Sheets

ELECTRICAL CONNECTOR

CROSS-REFERENCE TO RELATED APPLICATION

This application claims the benefit of Japanese Patent Application No. 2014-229634, filed on Nov. 12, 2014, the entire disclosure of which is incorporated by reference herein.

FIELD

This application relates to an electrical connector.

BACKGROUND

For example, Patent Literature 1 discloses an electrical connector which electrically connects a substrate on which one connector part is mounted with a substrate on which the other connector part is mounted by having these two engageable connector parts to engage with each other.

This electrical connector includes a plug reinforcement metal part provided to a plug connector, and a receptacle reinforcement metal part provided to a receptacle connector. A worker engages the connector parts with each other, and fits a fitting protrusion of the plug reinforcement metal part into a fitting hole of the receptacle reinforcement metal part, thereby maintaining the engagement between the plug connector and the receptacle connector.

When releasing the engagement between the plug connector and the receptacle connector, first, the worker inserts a tip of a scissors-shaped jig that is a special-purpose jig into a release hole in the substrate on which the plug connector is mounted. Subsequently, the worker inserts the tip of the jig into a jig insertion hole provided in the receptacle reinforcement metal part. In addition, the worker operates the jig to cause the receptacle reinforcement metal part to be elastically deformed, and disengages the fitting protrusion of the plug reinforcement metal part from the fitting hole of the receptacle reinforcement metal part, thereby releasing the engagement between the fitting protrusion and the fitting hole. Having maintained this condition, the worker disengages the plug connector and the receptacle connector from each other to release the engagement of the connectors with each other.

Thus, according to the electrical connector disclosed in Patent Literature 1, a false release of the engagement between the fitting protrusion and the fitting hole is preventable which is caused by, for example, an unexpected action by the worker.

CITATION LIST PATENT LITERATURE

Patent Literature 1: Unexamined Japanese Patent Application Kokai Publication No. 2011-65861.

SUMMARY

As described above, according to the electrical connector disclosed in Patent Literature 1, the scissors-shaped jig that is a special-purpose jig is necessary when releasing the engagement of the connectors from each other. In addition, when releasing the engagement, the worker needs to insert the tip of the scissors-shaped jig into the release hole in the substrate, and insert the tip of the scissors-shaped jig into the jig insertion hole of the receptacle reinforcement metal part, and further, the worker needs to maintain the elastically deformed condition of the receptacle reinforcement metal part by operating the jig.

Thus, according to the electrical connector disclosed in Patent Literature 1, there are problems such that a special-purpose jig is necessary, and a releasing operation of the engagement of the connector parts from each other is complicated.

The present disclosure has been made in view of the aforementioned circumstances, and an objective of the present disclosure is to provide an electrical connector which can surely maintain an engagement of connector parts, needs no special-purpose jig when the engagement of the connectors is released, and facilitates the releasing of the connector parts.

Solution to Problem

To achieve the objectives above, there is provided in accordance with the present disclosure, a managing device including:

a first connector that includes a first housing that has an insulating wall with an outer frame, the insulating wall forming an internal area of the first housing, and a first contact that is a conductive member extending from the wall toward an exterior of the first housing; and a second connector that includes a second housing that has an insulating wall at least partially disposed within the internal area of the first housing, and a second contact that is a conductive member extending from the wall of the second housing toward an exterior of the second housing, wherein:

the first housing and the second housing are engaged with each other to electrically connect the first contact with the second contact;

either one of the first connector or the second connector is mounted on a substrate permitting a fitting member to be inserted therein to maintain an engagement with an other connector, and formed with a through hole that permits the inserted fitting member to be pulled out when the engagement is released; and the other connector includes:

a receiver that is provided at a location corresponding to the fitting member inserted in the through hole when the one connector and the other connector are engaged with each other, and receives, in an inner space via an opening, a catching member to be fitted with the inserted fitting member; and a holder that holds the catching member received in the receiver by blocking off the opening of the receiver, and is formed with an receiving hole permitting the fitting member inserted in the through hole to reach the inner space, and to be fitted with the catching member.

The receiver may have the opening formed so as to face the through hole when the one connector and the other connector are engaged with each other; and the holder may further include:

a tabular top plate formed with the receiving hole blocking off the opening of the receiver; and a pair of tabular wall plates that is provided at both ends of the top plate, and is disposed along an outer wall of the receiver.

The receiving hole of the holder may permit the fitting member inserted in the through hole to reach the inner space, and to be screwed with the catching member.

The one connector may be mounted on the substrate formed with the through hole permitting a bolt to be inserted therein to maintain the engagement with the other connector, and permitting the bolt to be pulled out therefrom when the engagement is released;

the receiver may receive, in the inner space via the opening, a nut to be fitted with the bolt inserted in the through hole; and the receiving hole of the holder may permit the bolt inserted in the through hole to reach the inner space, and to be fastened with the nut.

The receiver may be formed with the opening so as to face the through hole when the one connector and the other connector are engaged with each other, and may include a holding wall that holds a pair of facing side surfaces among side surfaces of the nut received in the inner space via the opening; and the holder may include:

a tabular top plate formed with the receiving hole blocking off the opening of the receiver; and a pair of tabular wall plates that is provided at both ends of the top plate, and is disposed along an outer wall of the holding wall.

The holder may be formed of metal.

The pair of wall plates may include, at each of respective open ends, a connecting part that is to be connected to a substrate on which the other connector is mounted.

The receiver may be provided on a back-surface side of the substrate on which the other connecter is mounted so as to extend beyond the connecting part provided at the pair of wall plates, and the other connector may be mounted on the substrate formed with an aperture permitting a part of the receiver to be buried therein with the receiver being buried in the aperture.

The receiver may be disposed at each of both ends of the housing of the other connector.

When engaging housing parts with each other, a worker may insert the fitting member in the through hole of the substrate on which the one connector is mounted, and fit the fitting member with the catching member that is received in the receiver of the other connector. Conversely, when releasing the engagement of the housing parts from each other, the worker may release the fitted fitting member and the catching member from each other by, for example, a universal jig or the like. Thus, according to the electrical connector of the present disclosure, the engagement of the connector parts can be surely maintained, no special-purpose jig is necessary when the engagement of the connector parts is released, and releasing work of the connector parts is easy.

BRIEF DESCRIPTION OF THE DRAWINGS

A more complete understanding of this application can be obtained when the following detailed description is considered in conjunction with the following drawings, in which.

DETAILED DESCRIPTION

Hereinafter, an electrical connector 10 according to an embodiment of the present disclosure will be explained with reference to the accompanying drawings. Note that in each drawing, a Cartesian coordinate system is defined and referred as needed which has an x-axis direction that is a short-side direction of the electrical connector 10, a y-axis direction that is a long-side direction of the electrical connector 10, and a z-axis direction that is a height direction of the electrical connector 10. In addition, a direction of an arrow on each axis is indicated by + (positive), and an opposite direction is indicated by − (negative).

Figure 1:
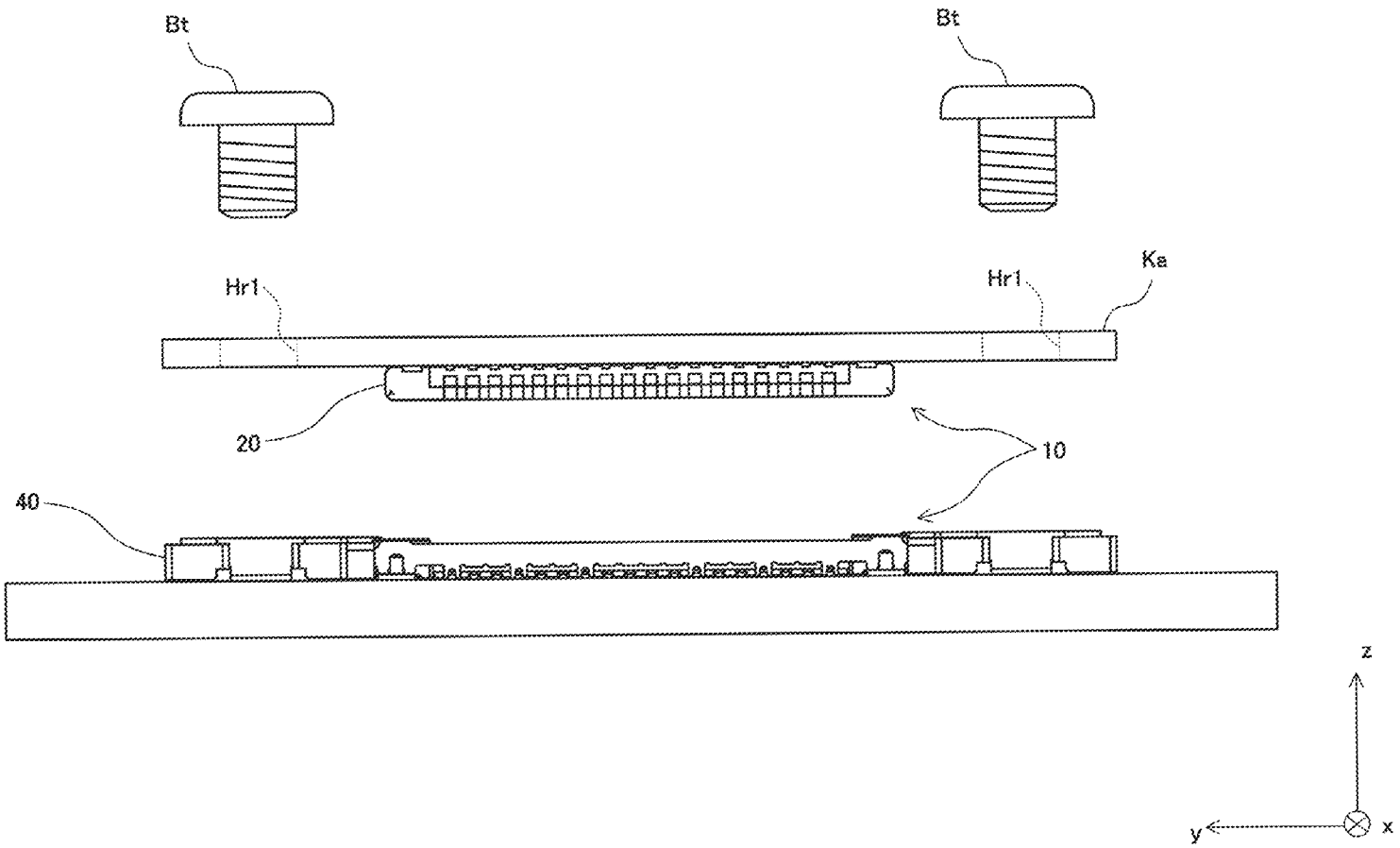
FIG. 1 is a side view of an electrical connector according to an embodiment of the present disclosure when mounted on a substrate.

The electrical connector 10 includes, as illustrated in a side view of FIG. 1, a plug connector 20, and a receptacle connector 40 to be engaged with the plug connector 20. The plug connector 20, and the receptacle connector 40 are respectively mounted on separate substrates.

When engaging the electrical connector 10, a worker engages the plug connector 20 with the receptacle connector 40. Next, the worker inserts a universal bolt Bt into a through hole Hr1 formed in a flexible substrate Ka on which the plug connector 20 is mounted, and fastens (fits) the bolt Bt with a universal nut Nt received in the receptacle connector 40. Thus, the electrical connector 10 maintains the engaged condition.

Figure 2:
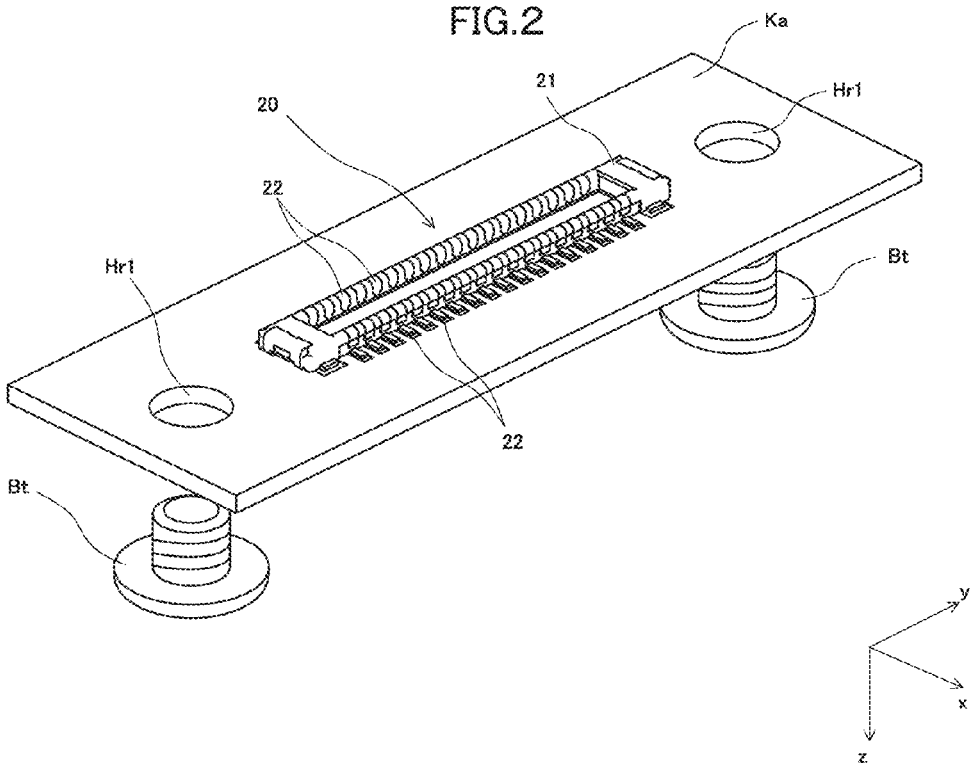
FIG. 2 is a perspective view of a plug connector as viewed from a receptacle-connector side in FIG. 1.

As illustrated in a perspective view (a perspective view of the plug connector 20 as viewed from the receptacle-connector-40 side in FIG. 1) of FIG. 2, the plug connector 20 is a rectangular frame, and has at least a part disposed within an internal area of the receptacle connector 40. In addition, the plug connector 20 includes a plug housing 21 that serves as insulating walls. The plug housing 21 is, for example, formed of plastic. The plug housing 21 is disposed on an x-y plane.

In addition, the plug connector 20 includes plug contacts 22 that are disposed at both ends of the plug housing 21 in the short-side direction. The plug contact 22 is a conductive member (for example, a copper alloy plate).

The plug contact 22 runs through an outer wall surface of the plug housing 21 from an inner wall surface of the plug housing 21, and extends toward the exterior of the plug housing 21. A connection end of the plug contact 22 is, for example, soldered to an electrode of the flexible substrate Ka that is highly flexible. Thus, the plug connector 20 is mounted on the flexible substrate Ka.

The bolt Bt that maintains the engagement with the receptacle connector 40 can be inserted into the through hole Hr1 of the flexible substrate Ka, and the bolt Bt can be pulled out from the through hole Hr1 when the engagement of the connector parts is released.

Figure 3:
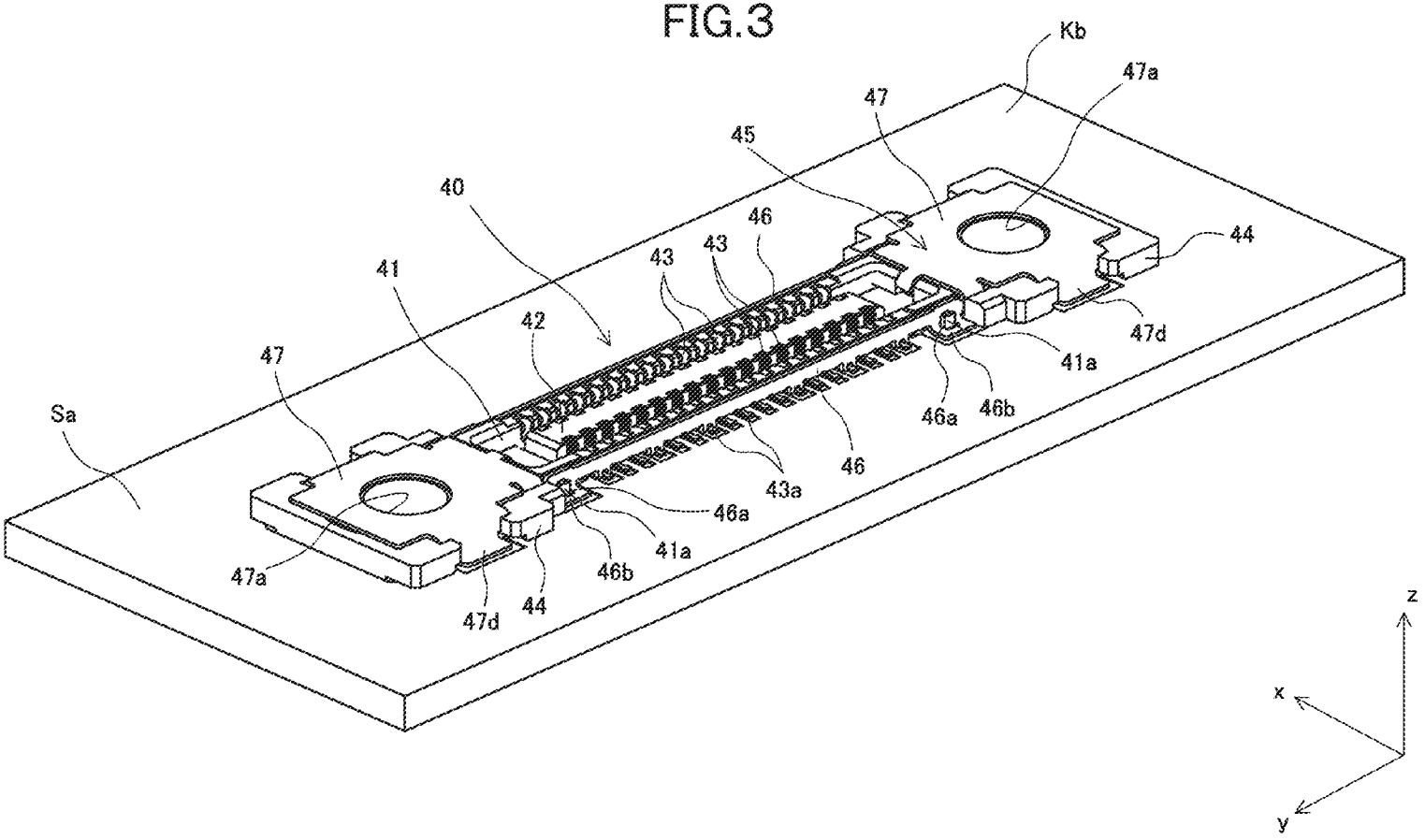
FIG. 3 is a perspective view of a receptacle connector mounted on a circuit substrate.

The above-described receptacle connector 40 that is engaged with the plug connector 20 includes, as illustrated in a perspective view of FIG. 3, a receptacle housing 41 which is a substantially rectangular frame, and which forms, with the insulating walls, the internal area to receive the plug housing 21. The receptacle housing 41 is, for example, formed of plastic. The receptacle housing 41 is disposed on the x-y plane.

The receptacle housing 41 includes, within an area surrounded by an outer frame, an integrally formed block 42 in a substantially cuboid shape. The plug housing 21 is received in the internal area formed by the block 42, and the receptacle housing 41. The receptacle housing 41 includes protrusions 41*a* that are to be fitted with a frame 46 which will be discussed later.

In addition, the receptacle connector 40 includes receptacle contacts 43 each of which is a conductive component running through a wall surface of the receptacle housing 41 in the short-side direction from a wall surface of the block 42 in the short-side direction, and extends toward the exterior of the receptacle housing 41.

The receptacle contact 43 is, for example, a copper alloy plate. A connection end 43*a* of the receptacle contact 43 is, for example, soldered to an electrode of a circuit board Kb that has a low flexibility. Thus, the receptacle connector 40 is mounted on the circuit board Kb.

In addition, the receptacle connector 40 includes a receiver 44 capable of receiving, within an internal space thereof, a nut having a structure capable of being fastened with the bolt Bt that is inserted into the through hole Hr1 of the flexible substrate Ka.

The receiver 44 is provided at each of both ends of the receptacle housing 41 in the long-side direction, and also at a location corresponding to the bolt Bt that is inserted into the through hole Hr1 of the flexible substrate Ka when the connector parts are engaged with each other.

Figure 4:
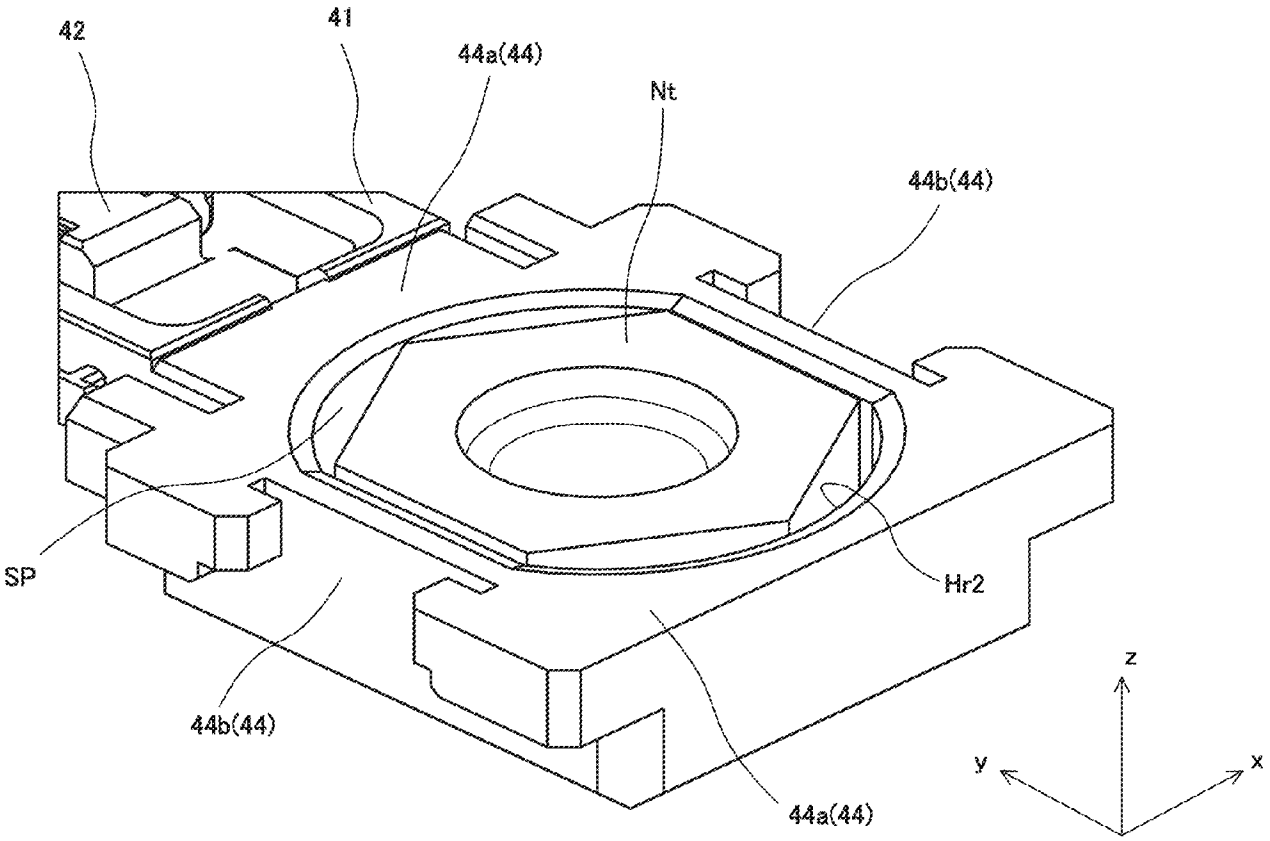
FIG. 4 is an enlarged perspective view of a receiver before an attaching member is attached.

As illustrated in a partial perspective view (a partial perspective view illustrating a condition before an attaching member 45 to be discussed later is attached) of FIG. 4, an opening Hr2 is formed in the receiver 44 so as to face the through hole Hr1 when the connector parts are engaged with each other. When the worker assembles the receptacle connector 40, the nut Nt is received in an inner space SP via this opening Hr2, that is, through this opening Hr2 serving as an entry.

The receiver 44 includes a pair of side walls 44*a* disposed in the long-side direction of the receptacle connector 40, and a pair of holding walls 44*b* disposed between the pair of side walls 44*a*. The pair of side walls 44*a* together with the pair of holding walls 44*b* forms the inner space SP that receives the nut Nt.

The pair of holding walls 44*b* is disposed so as to hold a pair of facing side surfaces among the side surfaces of the received nut Nt in the inner space SP. Thus, rotation torque applied from the nut Nt when the bolt Bt and the nut Nt are fastened together can be concentrated to the pair of holding walls 44*b*.

Note that the pair of holding walls 44*b* may abut the pair of side surfaces of the received nut Nt in the inner space SP to hold the pair of side surfaces, or may hold the pair of side surfaces of the nut Nt with a gap that is sufficient to prevent the nut Nt from rotating within the inner space SP being provided between the pair of side surfaces of the nut Nt.

In addition, the receptacle connector 40 includes, as illustrated in the perspective view of FIG. 3, the attaching member 45 that is integrally formed with a metal plate, and is to be attached to the receptacle housing 41. The attaching member 45 includes a frame 46 disposed at both ends of the outer wall surface of the receptacle housing 41 in the short-side direction, and a holder 47 that blocks off the opening Hr2 of the receiver 44.

A part of the frame 46 is connected to multiple ground terminals of the receptacle contact 43. Thus, the frame 46 allows electric potential of each ground terminal to be substantially equal potential. In addition, a fitting hole 46*a* capable of catching the protrusion 41*a* of the receptacle housing 41 is formed in the frame 46. Furthermore, the frame 46 includes a frame connector 46*b* that spreads outwardly.

The frame connector 46*b* is soldered to a metal layer (for example, a conducting path) of the circuit substrate Kb with the protrusion 41*a* being caught by the fitting hole 46*a*. Thus, the frame connector 46*b* firmly fastens the receptacle housing 41 to the circuit substrate Kb.

The holder 47 blocks off the opening Hr2 of the receiver 44 to hold the nut Nt received in the receiver 44. A receiving hole 47*a* that allows the bolt Bt inserted into the through hole Hr1 of the flexible substrate Ka to reach the inner space SP of the receiver 44, and to be fastened with the nut Nt is formed in the holder 44.

Figure 5A:
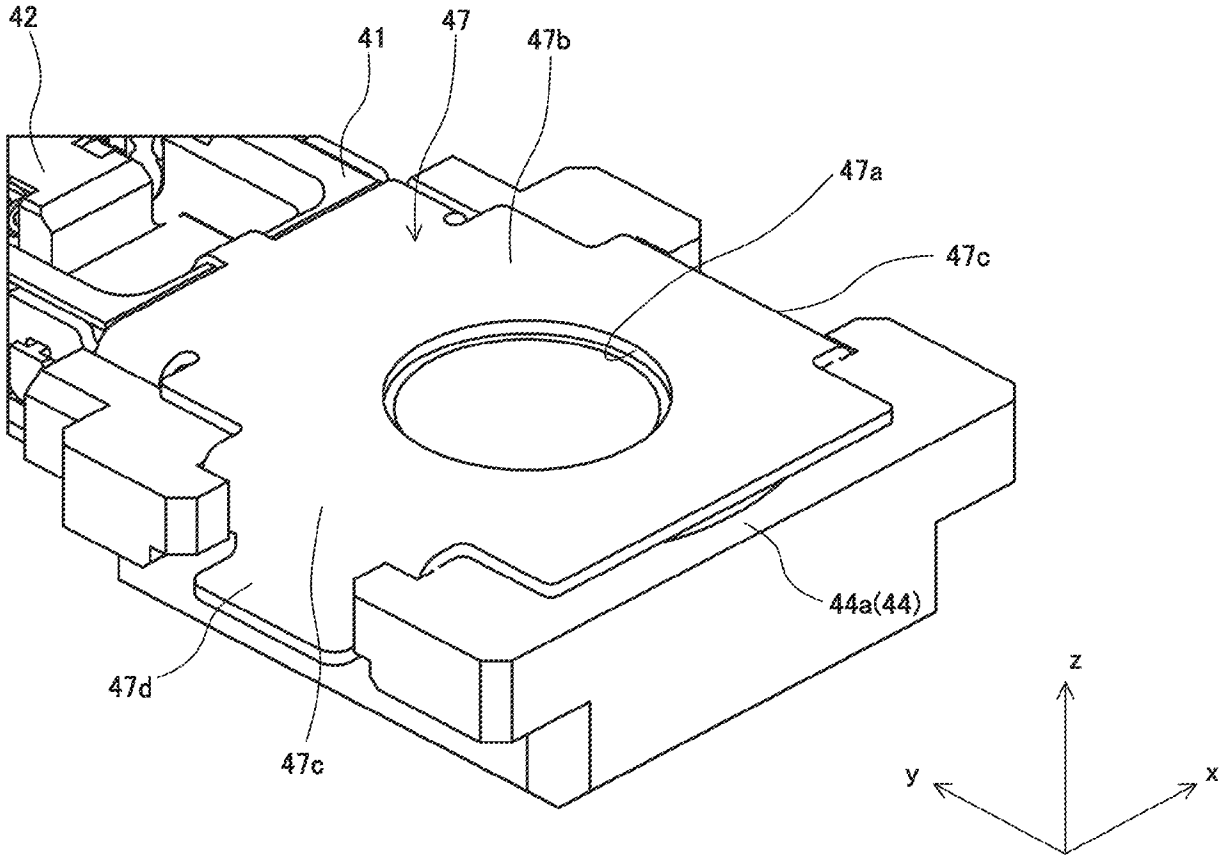
FIG. 5A is an enlarged perspective view of a receiver and a holder.
Figure 5B:
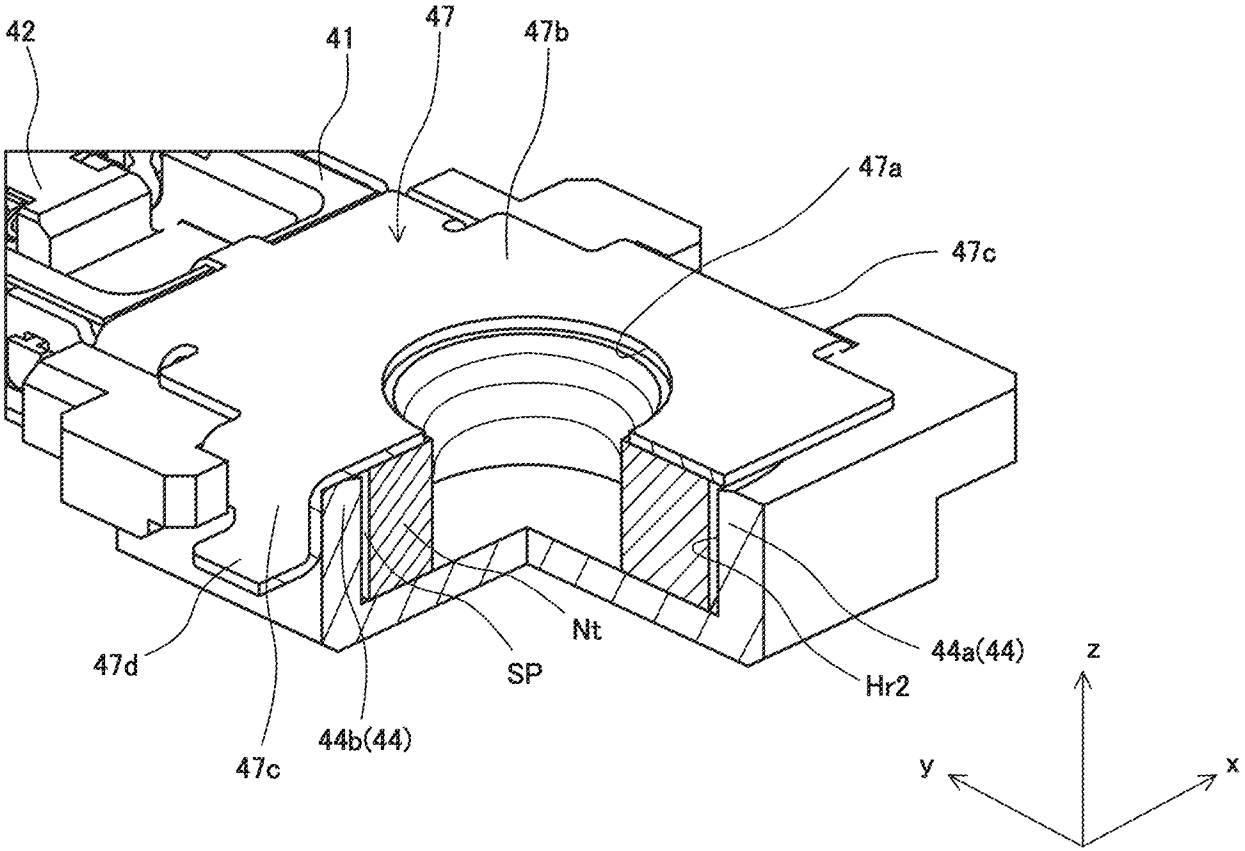
FIG. 5B is a perspective view with a portion of FIG. 5A being cut out for convenience.

As illustrated in a partial perspective view of FIG. 5A, and a partial perspective view (a portion of the electrical connector 10, and the like illustrated in FIG. 5A being cut out for convenience) of FIG. 5B, the holder 47 includes a top plate 47*b* in a tabular shape, and the receiving hole 47*a* is formed in the top plate 47*b*. In addition, the holder 47 includes a pair of wall plates 47*c* provided at both ends of the top plate 47*b* in the x-direction, and disposed along the outer wall of the receiver 44.

The top plate 47*b* blocks off the opening Hr2 of the receiver 44. In this case, the receiving hole 47*a* formed in the top plate 47*b* is disposed at a location corresponding to the bolt Bt when the connector parts are engaged with each other.

In addition, the pair of wall plates 47*c* is disposed along the pair of holding walls 44*b*. That is, the pair of wall plates 47*c* is disposed along a portion where rotation torque applied from the nut Nt when the bolt Bt and the nut Nt are fastened together is concentrated. Thus, the pair of wall plates 47*c* prevents the receiver 44 from being damaged even if rotation torque applied from the nut Nt increases.

Still further, the pair of wall plates 47*c* includes, at each open end, a wall plate connector 47*d* that spreads outwardly. The wall plate connector 47*d* is soldered to a metal layer (for example, a conducting path) of the circuit substrate Kb. The soldered wall plate connector 47*d* also prevents the receiver 44 from being damaged when rotation torque applied from the nut Nt increases.

Figure 6A:
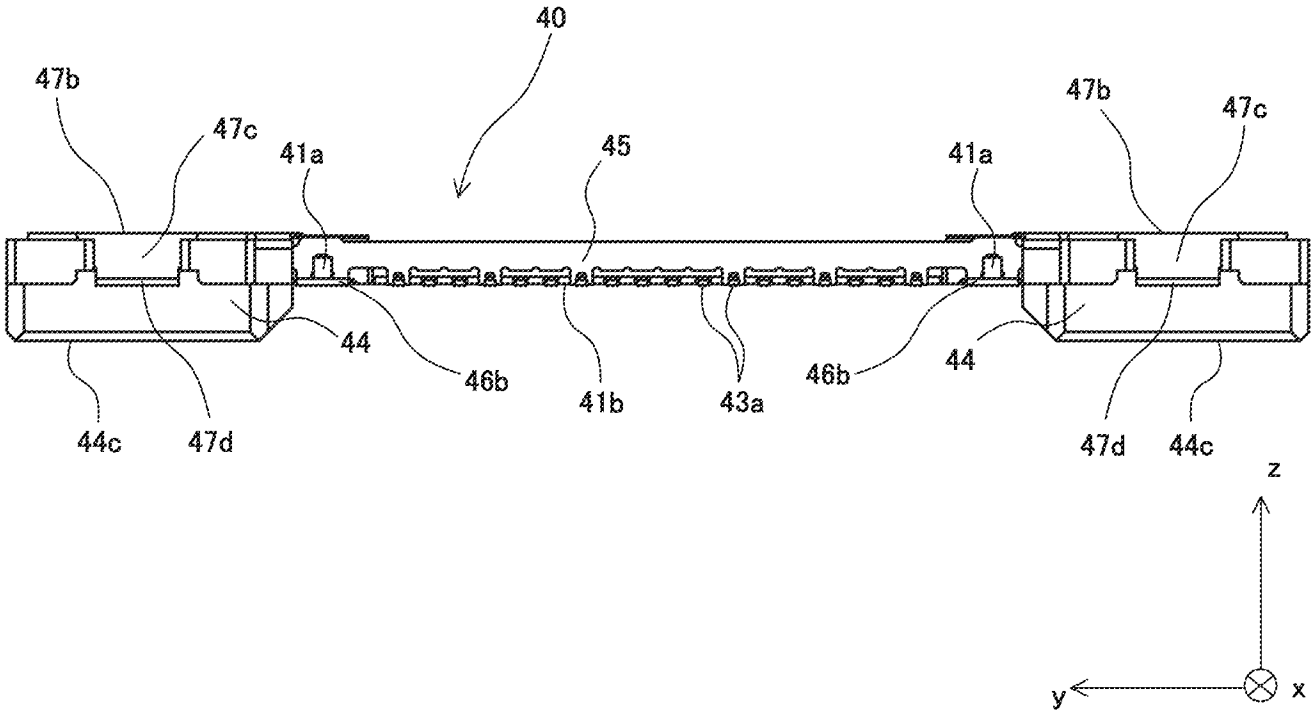
FIG. 6A is a side view of a receptacle connector.
Figure 6B:
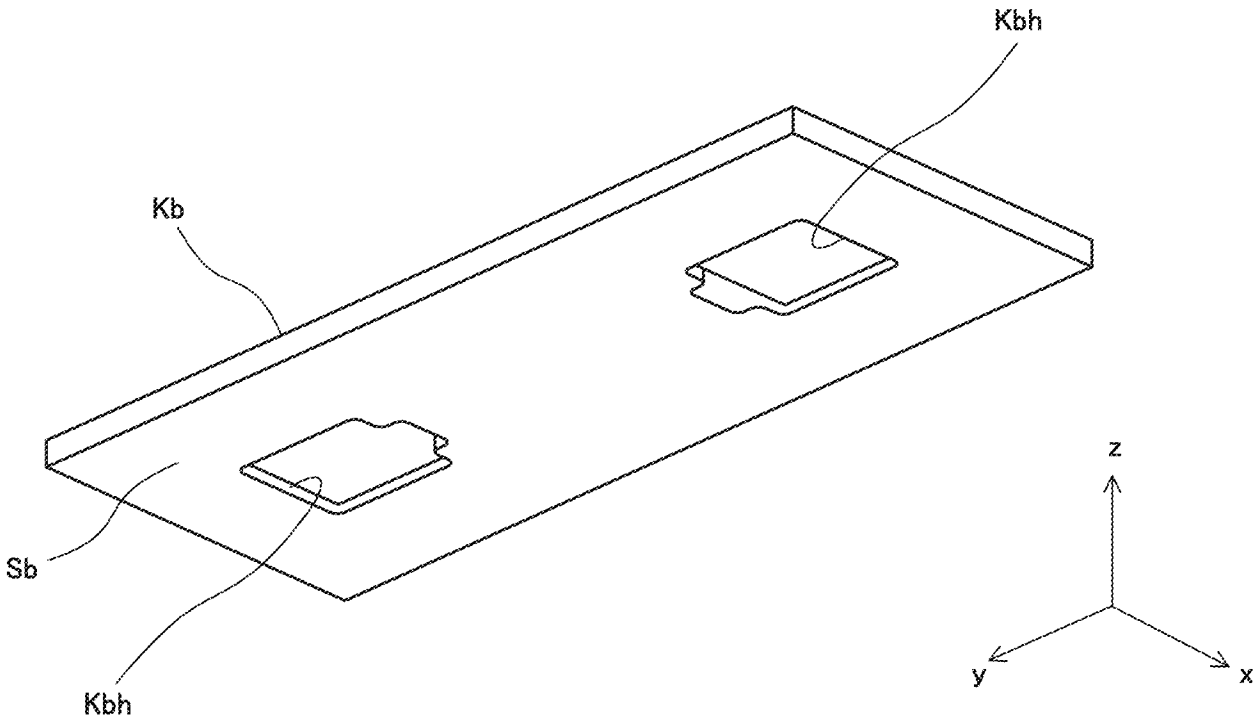
FIG. 6B is a perspective view of a circuit substrate on which a receptacle connector is mounted.

In this case, as illustrated in a side view of FIG. 6A, a bottom surface 44*c* of the receiver 44 is disposed at a different height level from that of the connection end 43*a* of the receptacle contact 43, and is extended beyond a bottom surface 41*b* of the receptacle housing 41, and the wall plate connector 47*d*. Thus, as illustrated in a perspective view of FIG. 6B, an aperture Kbh in which a part of the receiver 44 can be buried is formed in the circuit substrate Kb.

Figure 7A:
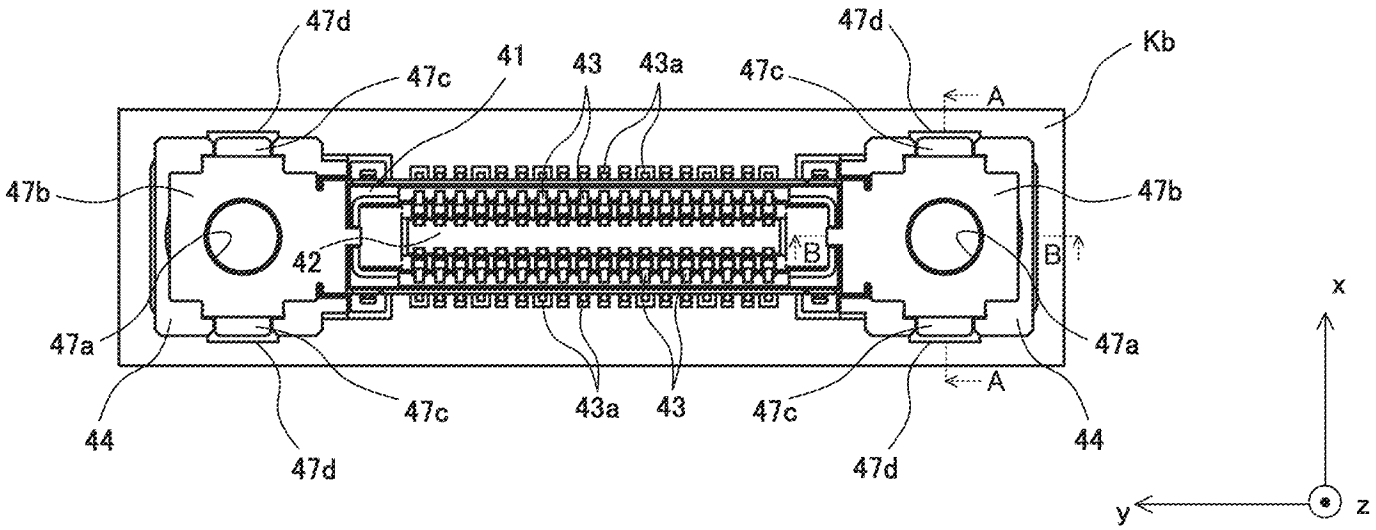
FIG. 7A is a top view of a receptacle connector mounted on a circuit substrate.
Figure 7B:
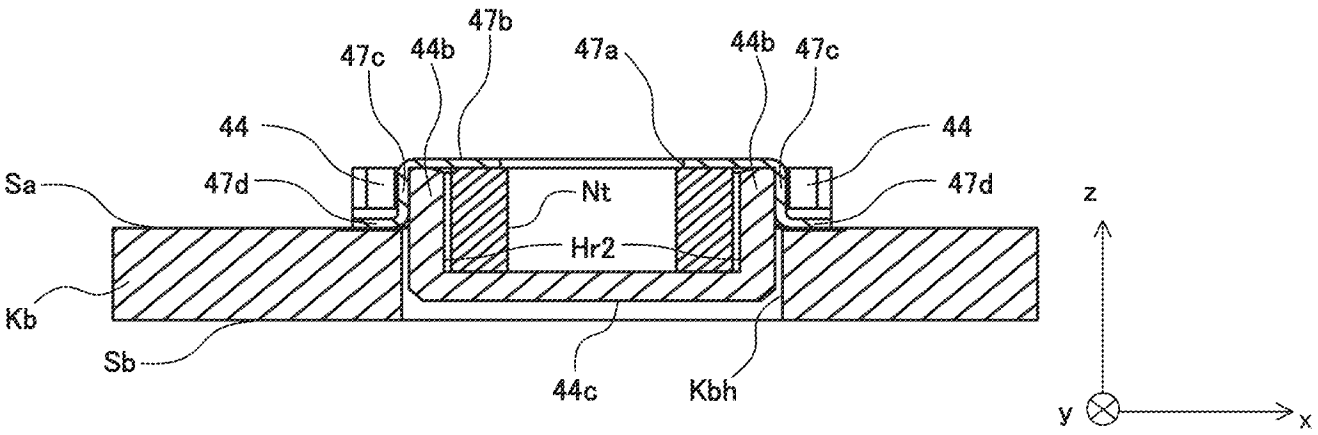
FIG. 7B is a cross-sectional view taken along a line A-A in FIG. 7A.
Figure 7C:
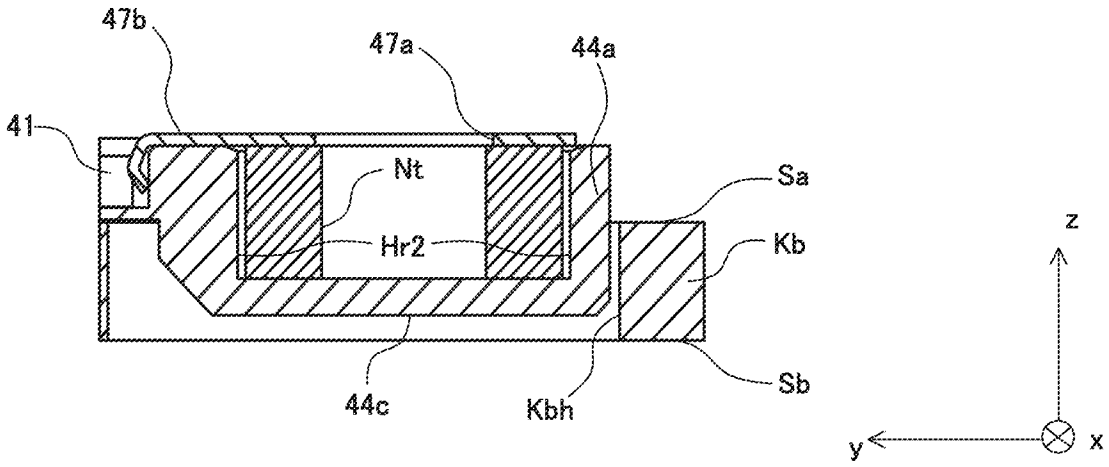
FIG. 7C is a cross-sectional view taken along a line B-B in FIG. 7A.

When a part of the receiver 44 is buried in the aperture Kbh, the wall plate connector 47*d* comes into contact with a mount surface Sa of the circuit substrate Kb, as illustrated in a cross-sectional view (a cross-sectional view taken along the line A-A in FIG. 7A) of FIG. 7B, and a cross-sectional view (a cross-sectional view taken along the line B-B in FIG. 7A) of FIG. 7C. Likewise, the connection end 43*a* of the receptacle contact 43, and the frame connector 46*b* also come into contact with the mount surface Sa of the circuit substrate Kb.

Accordingly, in the receptacle connector 40, a part of the receiver 44 can be buried in the aperture Kbh. Thus, the receptacle connector 40 is capable of reducing (shortening) the height (a length in +z direction) from the mount surface Sa.

In addition, since a part of the receiver 44 can be buried in the aperture Kbh, the bottom surface 44*c* of the receiver 44 can be extended toward a back-surface-Sb side (an opposite surface side to the mount surface Sa on which the wall plate connector 47*d* is mounted) of the circuit substrate Kb beyond the bottom surface 41*b* of the receptacle housing 41, and the wall plate connector 47*d*.

Accordingly, by extending the bottom surface 44*c* of the receiver 44 toward the back-surface-Sb side (by extending the bottom surface 44*c* of the receiver 44 in −z direction), the nut Nt with a deep hole in which the bolt Bt is to be inserted can be received in the receiver 44. That is, the nut Nt which has the desired number of grooves (the number of threads to realize meshing (fitting) with the bolt Bt) formed in an inner circumferential wall of the hole in the nut Nt can be received in the receiver 44.

Hence, when the engagement of the connector parts is maintained, the electrical connector 10 can realize firm fastening between the bolt Bt inserted in the through hole Hr1 of the flexible substrate Ka and the nut Nt received in the receiver 44.

Figure 8A:
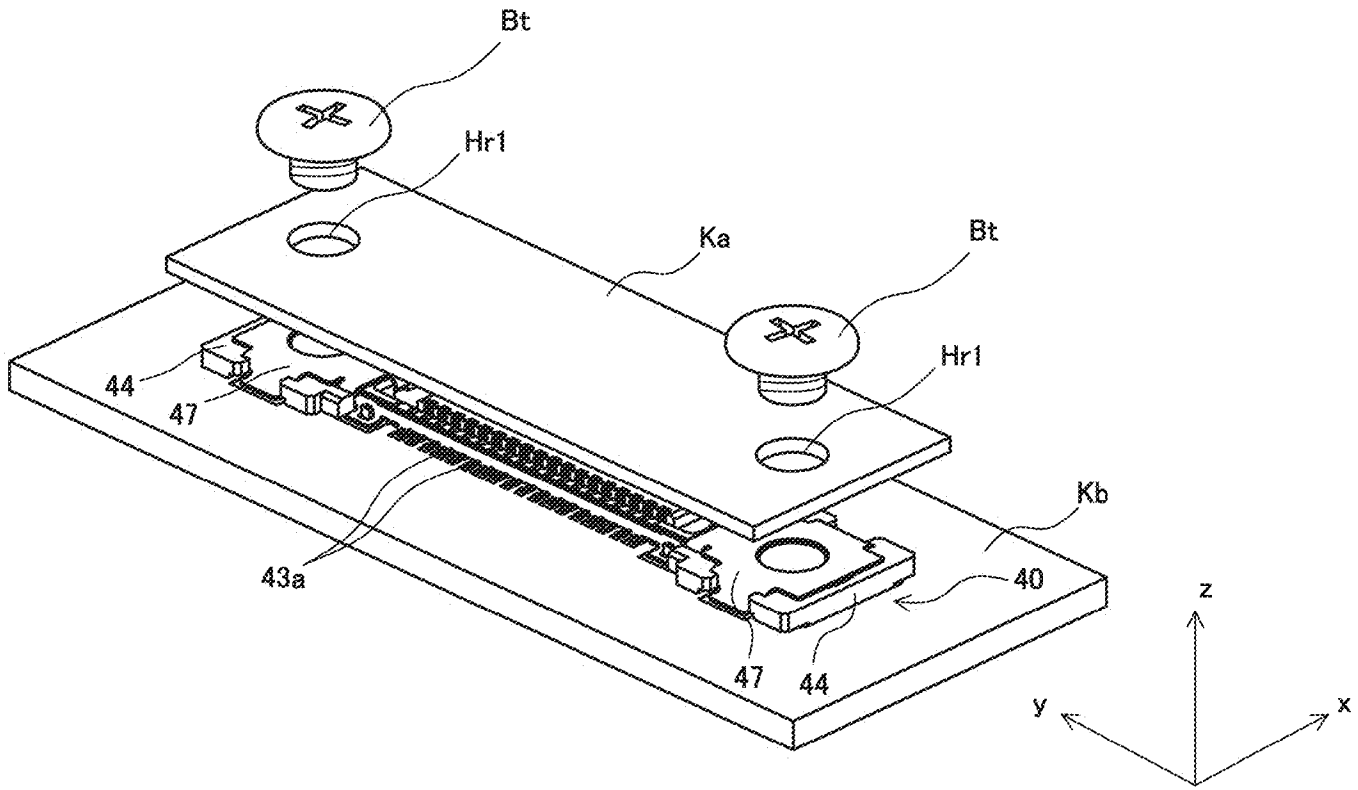
FIG. 8A is a perspective view before a plug connector is engaged with a receptacle connector.
Figure 8B:
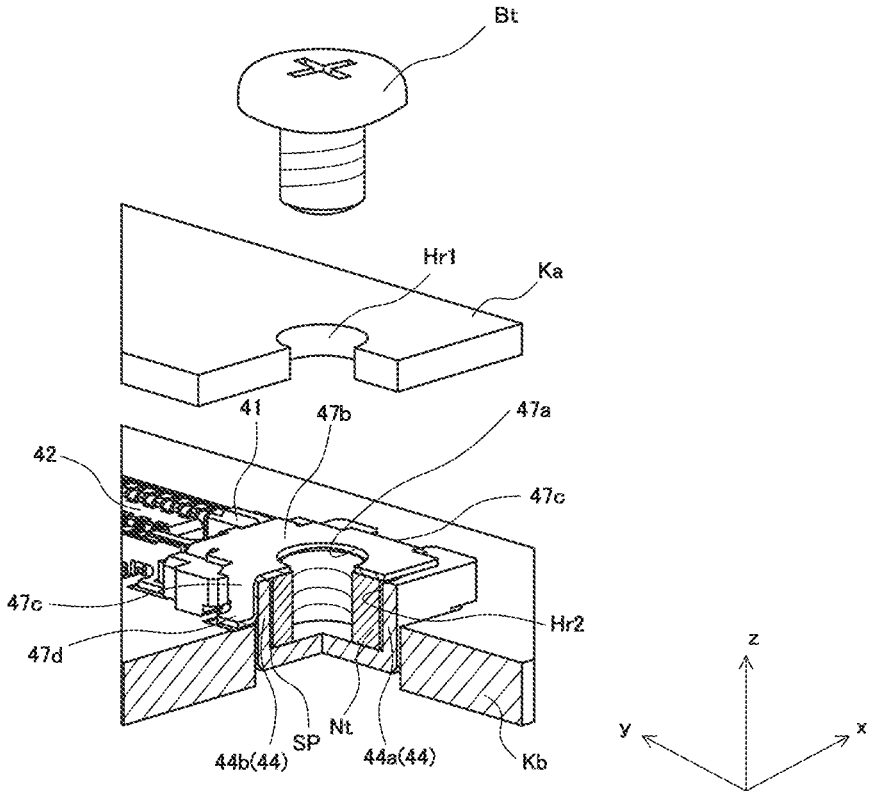
FIG. 8B is a perspective view with a portion of FIG. 8A being enlarged, and cut out for convenience.

As illustrated in a perspective view of FIG. 8A, and a partial perspective view (a portion of the electrical connector 10, and the like illustrated in FIG. 8A being cut out for convenience) of FIG. 8B, when the above-described plug connector 20 and receptacle connector 40 are fastened with each other, the worker causes, for example, the plug connector 20 mounted on the flexible substrate Ka to directly face the receptacle connector 40 mounted on the circuit substrate Kb.

Figure 9A:
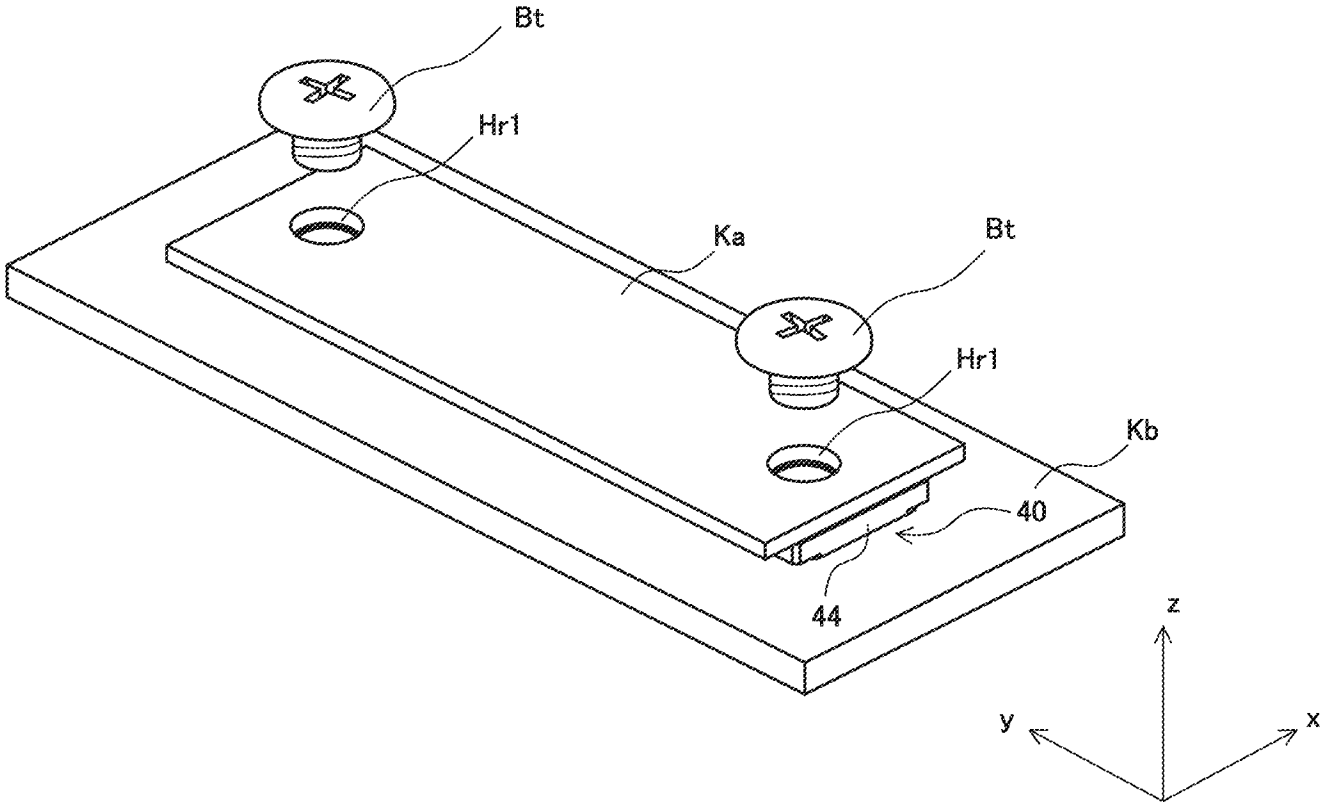
FIG. 9A is a perspective view when a plug connector is engaged with a receptacle connector.
Figure 9B:
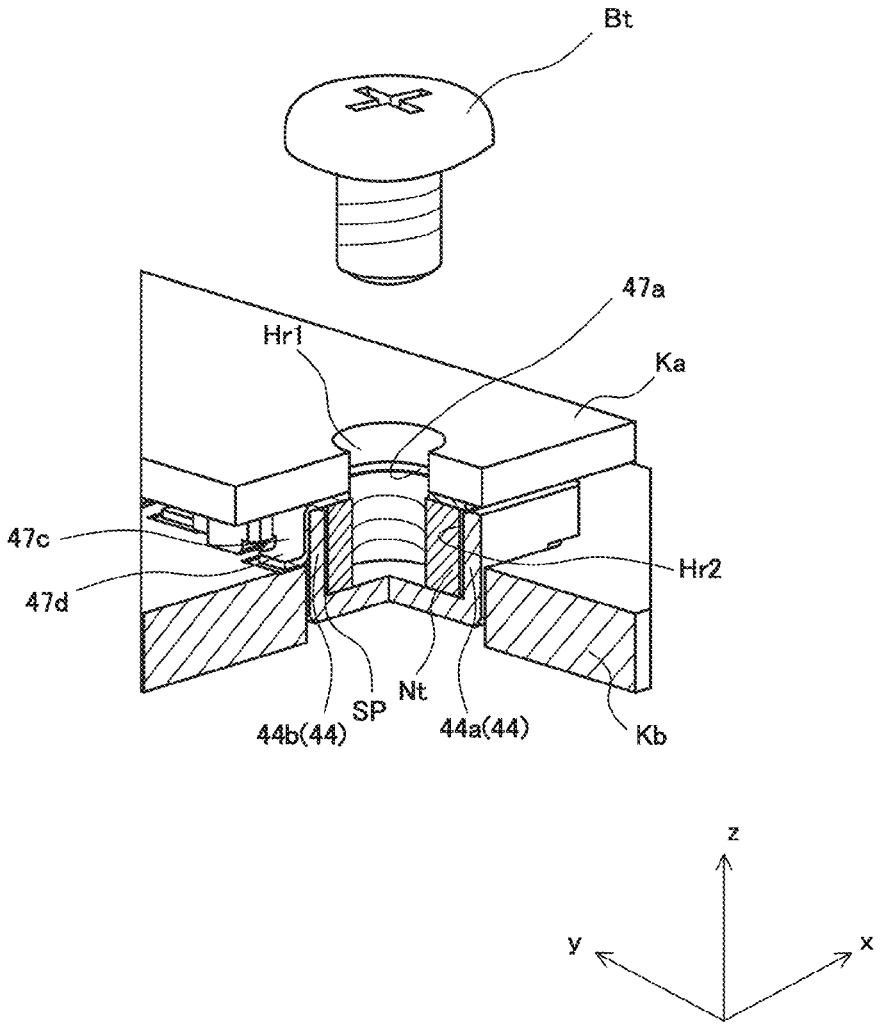
FIG. 9B is a perspective view with a portion of FIG. 9A being enlarged, and cut out for convenience.

Next, as illustrated in a perspective view of FIG. 9A, and a partial perspective view (a portion of the electrical connector 10, and the like illustrated in FIG. 9A being cut out for convenience) of FIG. 9B, the worker engages the plug housing 21 with the receptacle housing 41.

Subsequently, the worker inserts the bolt Bt into the through hole Hr1 provided in the flexible substrate Ka. Next, the worker passes the tip of the bolt Bt through the receiving hole 47*a* of the holder 47 to cause the tip of the bolt Bt to reach the inner space SP of the receiver 44. Thereafter, the worker causes the tip of the bolt Bt to be in contact with the hole of the nut Nt, and turns the bolt Bt with a universal jig like a driver.

Figure 10A:
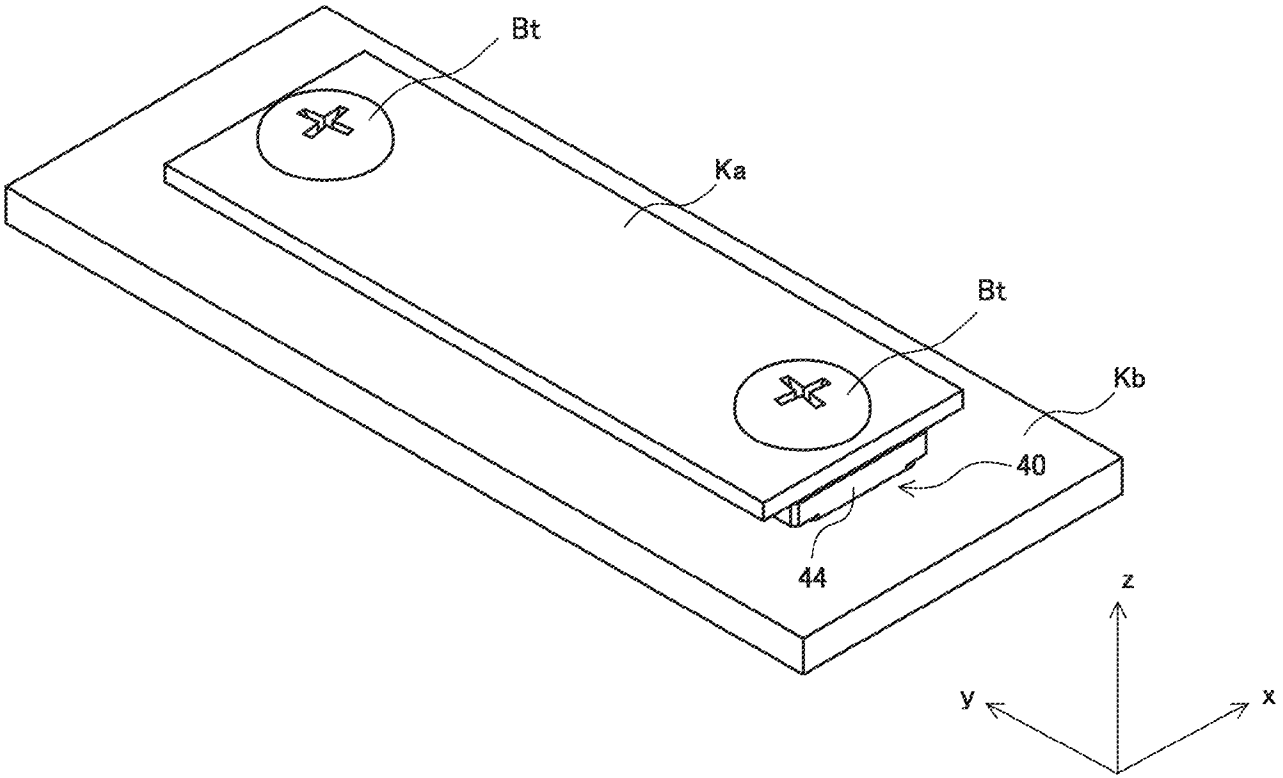
FIG. 10A is a perspective view when a plug connector is engaged with a receptacle connector, and a received nut is fastened with a bolt.
Figure 10B:
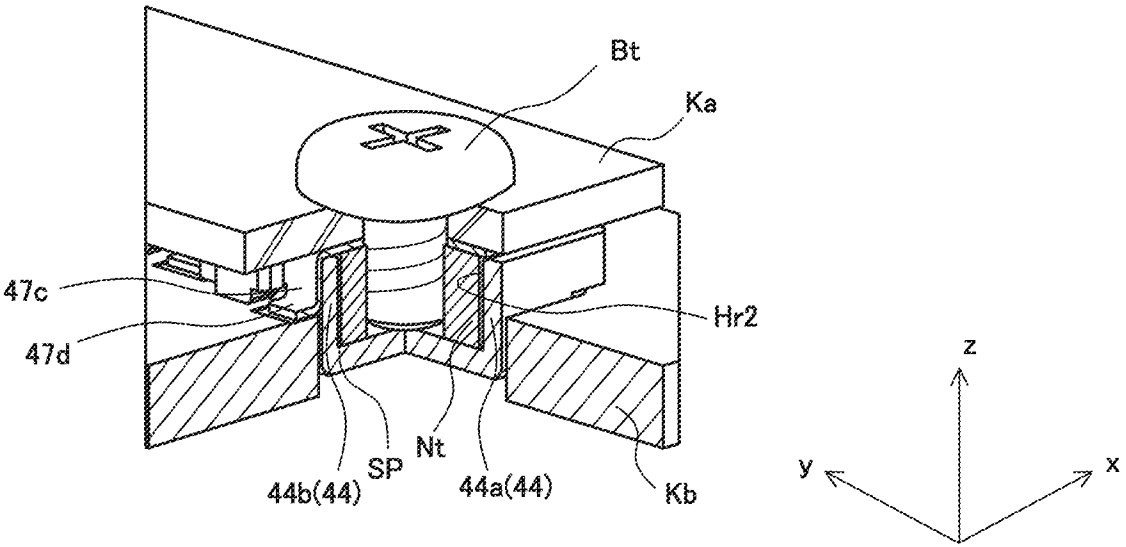
FIG. 10B is a perspective view with a portion of FIG. 10A being enlarged, and cut out for convenience.

Hence, as illustrated in a perspective view of FIG. 10A, the bolt Bt is screwed in, and the bolt Bt inserted into the through hole Hr1, and the nut Nt received in the receiver 44 are fastened (fitted) together as illustrated in a partial perspective view (a portion of the electrical connector 10, and the like illustrated in FIG. 10A being cut out for convenience) of FIG. 10B. Thus, the engagement between the plug connector 20 and the receptacle connector 40 is maintained.

Note that when the plug connector 20 and the receptacle connector 40 are engaged with each other, the plug contact 22 and the receptacle contact 43 come in contact with each other. Thus, wirings of the flexible substrate Ka connected to the plug contact 22, and wirings of the circuit substrate Kb connected to the receptacle contact 43 are electrically connected.

When releasing the engagement between the plug connector 20 and the receptacle connector 40 in order to, for example, replace the plug connector 20 after the engagement of the connector parts is maintained, the worker turns the bolt Bt that has been fastened with the nut Nt by a universal jig like a driver in a direction opposite to the fastening direction.

Accordingly, the engagement between the bolt Bt and the nut Nt is released. Thus, the engagement between the plug connector 20 and the receptacle connector 40 can be released. In this condition, the worker pulls out the bolt Bt from the receiving hole 47*a*, and the through hole Hr1, disengages the plug connector 20 and the receptacle connector 40 from each other, and, for example, replaces the plug connector 20.

As described above, according to the electrical connector 10 of this embodiment, when engaging the plug connector 20 and the receptacle connector 40 with each other, the worker may insert the bolt Bt into the through hole Hr1 of the flexible substrate Ka on which the plug connector 20 is mounted, and fasten (fit) the bolt Bt with the nut Nt received in the receiver 44 of the receptacle connector 40 by a universal jig like a driver.

Conversely, when releasing the engagement of the housing parts from each other, the worker may simply release the engagement between the bolt Bt and the nut Nt by a universal jig like a driver. Thus, according to the electrical connector 10, the engagement of the connector parts can be surely maintained, no special-purpose jig is necessary when the engagement of the connector parts is released, and releasing work of the connector parts is easy.

In addition, according to the electrical connector 10 of this embodiment, the pair of holding walls 44*b* forming the receiver 44 holds the pair of facing side surfaces among the side surfaces of the received nut Nt in the inner space SP. Thus, rotation torque applied from the nut Nt when the bolt Bt and the nut Nt are fastened together can be concentrated to the pair of holding walls 44*b*.

Still further, the pair of wall plates 47*c* is disposed along the pair of holding walls 44*b*, that is, along the portion where rotation torque applied from the nut Nt concentrates. Thus, the electrical connector 10 can prevent the receiver 44 from being damaged even if the rotation torque applied from the nut Nt instantaneously increases at the time of fastening.

Yet still further, since the pair of wall plates 47*c* is disposed, the receiver 44 can be prevented from being damaged even if the number of fastening and releasing works for the bolt Bt and the nut Nt cumulatively increases, and even if the number of applications of rotation torque to the pair of holding walls 44*b* from the nut Nt cumulatively increases.

In addition, the holder 47 that includes the pair of wall plates 47*c* is formed of metal. Thus, the holder 47 further prevents the receiver 44 from being damaged by application of rotation torque in comparison with a case in which the holder 47 is formed of, for example, plastic.

Still further, the pair of wall plates 47*c* includes, in each of open ends, the wall plate connector 47*d*. This wall plate connector 47*d* is soldered to a metal layer (for example, a conducting path) of the circuit substrate Kb, thereby further preventing the receiver 44 from being damaged.

Yet still further, according to the electrical connector 10 of this embodiment, a part of the receiver 44 can be buried in the aperture Kbh. Thus, according to the electrical connector 10 of this embodiment, the height (the length in +z direction) of the receptacle connector 40 from the mount surface Sa of the circuit substrate Kb can be reduced (shortened).

In addition, by having a part of the receiver 44 buried in the aperture Kbh, the bottom surface 44*c* of the receiver 44 can be extended to the back-surface-Sb side of the circuit substrate Kb. Thus, the nut Nt with a deep hole into which the bolt Bt is inserted can be received in the receiver 44.

Thus, according to the electrical connector 10 of this embodiment, the nut Nt which has the desired number of grooves (the number of grooves to realize meshing (fitting) with the bolt Bt) formed in the inner circumferential wall of the hole in the nut Nt can be received in the receiver 44.

Therefore, according to the electrical connector 10 of this embodiment, when the engagement of the connector parts is maintained, firm fastening between the bolt Bt inserted into the through hole Hr1 of the flexible substrate Ka, and the nut Nt received in the receiver 44 can be realized.

Yet further, according to the electrical connector 10 of this embodiment, the receiver 44 is disposed at each of both ends of the receptacle housing 41 in the long-side direction. Thus, according to the electrical connector 10 of this embodiment, the firm and well-balanced engagement of the connector parts can be maintained.

The embodiment of the present disclosure was described above, but the present disclosure is not limited to the aforementioned embodiment, and various modifications and applications can be made thereto.

According to the electrical connector 10 of the embodiment described above, the opening Hr2 of the receiver 44 serving as an entry for the nut Nt was formed in the flexible substrate Ka so as to face the through hole Hr1 when the connector parts are engaged with each other. However, the present disclosure is not limited to this structure.

Figure 11:
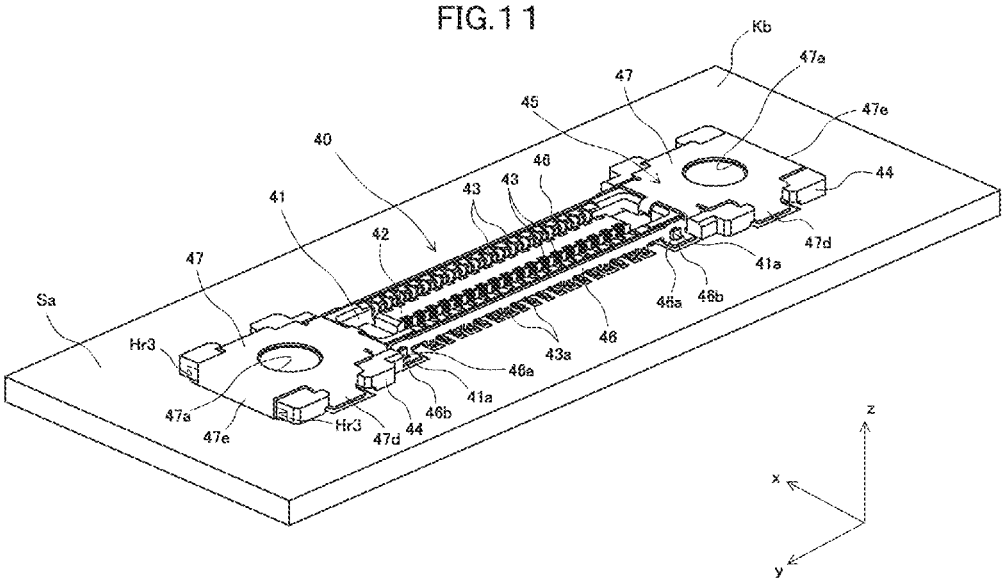
FIG. 11 is a perspective view of a modified example of a receptacle connector.

For example, as illustrated in a perspective view of FIG. 11, an opening Hr3 that serves as an entry for the nut Nt may be formed in each end of the receiver 44 located at the outermost side of the receptacle connector 40 in the long-side direction. When the opening Hr3 is formed in this manner, a tabular outer plate 47*e* may be disposed at the open end of the holder 47 located at the outermost side of the receptacle connector 40 in the long-side direction so as to cover the opening Hr3 along the outer wall of the receiver 44.

In addition, according to the electrical connector 10 of the embodiment described above, the through hole Hr1 was provided in the flexible substrate Ka on which the plug connector 20 is mounted, and the receiver 44 and the holder 47 were provided to the receptacle connector 40, but the present disclosure is not limited to this structure.

The receiver 44 and the holder 47 may be provided to the plug connector 20, and the through hole Hr1 may be provided in the circuit substrate Kb on which the receptacle connector 40 is mounted.

Still further, according to the electrical connector 10 of the embodiment described above, grooves were formed in the inner circumferential wall of the nut Nt to realize fastening (fitting) with the bolt Bt, but the present disclosure is not limited to this structure. That is, the inner circumferential wall of the nut Nt may be formed with no groove. According to this structure, when the worker screws the bolt Bt in the nut Nt at the first time, the threads of the bolt Bt cut the inner circumferential wall of the nut Nt, thereby forming the grooves in the inner circumferential wall of the nut Nt.

In addition, when no groove is formed in the inner circumferential wall of the nut Nt, the following structure may be employed. That is, instead of the grooves, the nut Nt includes convexities on the inner circumferential wall which protrude toward an axial center. In addition, instead of the bolt Bt, a bolt-shaped member that includes a head spreading outwardly, and a bar-shaped axis having a smaller diameter than that of the head is applied. In this case, concavities concaved inwardly are formed in the axis.

According to this structure, when the bolt-shaped member is inserted into the groove-less nut Nt, the convexities formed on the inner circumferential wall of the groove-less nut Nt, and the concavities formed in the axis of the bolt-shaped member are meshed (fitted) with each other. Thus, the engagement between the plug connector 20 and the receptacle connector 40 can be maintained.

Conversely, when releasing the engagement between the plug connector 20 and the receptacle connector 40, the worker pulls out the bolt-shaped member fitted with the groove-less nut Nt by, for example, a hand. Thus, the meshing between the bolt-shaped member and the nut Nt is released, and thus the engagement between the plug connector 20 and the receptacle connector 40 can be released.

As described above, the engagement and the release thereof between the plug connector 20 and the receptacle connector 40 can also be realized by the groove-less nut Nt and the bolt-shaped member.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SYMBOLS

10 Electrical connector, 20 Plug connector, 21 Plug housing, 22 Plug contact, 40 Receptacle connector, 41 Receptacle housing, 41*a* Protrusion, 41*b*, 44*c* Bottom surface, 42 Block, 43 Receptacle contact, 43*a* Connection end, 44 Receiver, 44*a* Side wall, 44*b* Holding wall, 45 Attaching member, 46 Frame, 46*a* Fitting hole, 46*b* Frame connector, 47 Holder, 47*a* Receiving hole, 47*b* Top plate, 47*c* Wall plate, 47*d* Wall plate connector, 47*e* Outer plate, Bt Bolt, Hr1 Through hole, Hr2, Hr3 Opening, Ka Flexible substrate, Kb Circuit substrate, Kbh Aperture, Nt Nut, Sa Mount surface, Sb Back surface, SP Inner space

What is claimed is:

1. An electrical connector comprising:

a first connector including a first housing that has an insulating wall with an outer frame, the insulating wall forming an internal area of the first housing, and a first contact that is a conductive member extending from the wall toward an exterior of the first housing; and a second connector including a second housing that has an insulating wall at least partially disposed within the internal area of the first housing, and a second contact that is a conductive member extending from the wall of the second housing toward an exterior of the second housing, wherein:

the first housing and the second housing are engaged with each other to electrically connect the first contact with the second contact;

either one of the first connector or the second connector is mounted on a substrate permitting a fitting member to be inserted therein to maintain an engagement with an other connector, and formed with a through hole that permits the inserted fitting member to be pulled out when the engagement is released; and the other connector comprises:

a receiver that is provided at a location corresponding to the fitting member inserted in the through hole when the one connector and the other connector are engaged with each other, and receives, in an inner space via an opening, a catching member to be fitted with the inserted fitting member; and a holder that holds the catching member received in the receiver by blocking off the opening of the receiver, and is formed with an receiving hole permitting the fitting member inserted in the through hole to reach the inner space, and to be fitted with the catching member.

2. The electrical connector according to claim 1, wherein:

the receiver has the opening formed so as to face the through hole when the one connector and the other connector are engaged with each other; and the holder further comprises:

a tabular top plate formed with the receiving hole blocking off the opening of the receiver; and a pair of tabular wall plates that is provided at both ends of the top plate, and is disposed along an outer wall of the receiver.

3. The electrical connector according to claim 1, wherein the receiving hole of the holder permits the fitting member inserted in the through hole to reach the inner space, and to be screwed with the catching member.

4. The electrical connector according to claim 3, wherein:

the one connector is mounted on the substrate formed with the through hole permitting a bolt to be inserted therein to maintain the engagement with the other connector, and permitting the bolt to be pulled out therefrom when the engagement is released;

the receiver receives, in the inner space via the opening, a nut to be fitted with the bolt inserted in the through hole; and the receiving hole of the holder permits the bolt inserted in the through hole to reach the inner space, and to be fastened with the nut.

5. The electrical connector according to claim 4, wherein:

the receiver is formed with the opening so as to face the through hole when the one connector and the other connector are engaged with each other, and comprises a holding wall that holds a pair of facing side surfaces among side surfaces of the nut received in the inner space via the opening; and the holder comprises:

a tabular top plate formed with the receiving hole blocking off the opening of the receiver; and a pair of tabular wall plates that is provided at both ends of the top plate, and is disposed along an outer wall of the holding wall.

6. The electrical connector according to claim 5, wherein the holder is formed of metal.

7. The electrical connector according to claim 6, wherein the pair of wall plates comprises, at each of respective open ends, a connecting part that is to be connected to a substrate on which the other connector is mounted.

8. The electrical connector according to claim 7, wherein:

the receiver is provided on a back-surface side of the substrate on which the other connecter is mounted so as to extend beyond the connecting part provided at the pair of wall plates; and the other connector is mounted on the substrate formed with an aperture permitting a part of the receiver to be buried therein with the receiver being buried in the aperture.

9. The electrical connector according to claim 1, wherein the receiver is disposed at each of both ends of the housing of the other connector.

* * * * *